United States Patent [19]

Achter et al.

[11] 3,936,779

[45] Feb. 3, 1976

[54] VACUUM-TIGHT WINDOW ARRANGEMENT FOR A RECTANGULAR-HOLLOW CONDUCTOR

[75] Inventors: Eugen Achter; Fritz Hanf, both of Munich; Wolf Wiehler, Neubiberg, all of Germany

[73] Assignee: Siemens Aktiengesellschaft, Berlin & Munich, Germany

[22] Filed: Mar. 5, 1975

[21] Appl. No.: 555,566

[30] Foreign Application Priority Data

Mar. 12, 1974 Germany ..... 2411798

[52] U.S. Cl. ..... 333/98 P; 333/33

[51] Int. Cl.[2] ..... H01P 1/04; H01P 1/08

[58] Field of Search ..... 333/98 R, 98 S, 98 P, 13, 333/22 F, 81 B, 33; 29/600; 315/39

[56] References Cited

UNITED STATES PATENTS

| | | | |
|---|---|---|---|
| 2,422,189 | 6/1947 | Fiske | 333/98 P |
| 2,577,118 | 12/1951 | Fiske | 333/13 X |
| 2,610,249 | 9/1952 | Fiske | 333/98 P |
| 3,646,485 | 2/1972 | Gross et al. | 333/98 P |

*Primary Examiner*—James W. Lawrence
*Assistant Examiner*—Marvin Nussbaum
*Attorney, Agent, or Firm*—Hill, Gross, Simpson, Van Santen, Steadman, Chiara & Simpson

[57] ABSTRACT

A microwave window of dielectric material having a rectangular shape is received in a hollow, rectangular cross-section conductor with a multi-piece metal bandage positioned around a portion of the conductor and retaining the window in place, the bandage being soldered in place.

7 Claims, 3 Drawing Figures

VACUUM-TIGHT WINDOW ARRANGEMENT FOR A RECTANGULAR-HOLLOW CONDUCTOR

BACKGROUND OF THE INVENTION

1. Field of the Invention

This invention relates to hollow conductors having wave permeable rectangular cross-section dielectric material windows received therein in a vacuum tight condition with a metal bandage surrounding the conductor at the level of the window to maintain the window in place while providing a functioning seal.

2. Prior Art

Rectangular cross-section conductors used with inserted rectangular cross-section wave permeable windows of dielectric material are useful in many environments.

Microwave windows of wave permeable dielectric material are known. One such window is described in German Offenlegungsschrift No. 1,931,712 (U.S. Pat. No. 3,646,485). In such prior art embodiments, the ceramic window generally does not have a shape equal to the shape of the hollow conductor or wave guide in which it is received. Thus, one may be rectangular while the other is of an oval shape in order to facilitate the provision of a vacuum tight soldering around the window position. In such constructions, the hollow conductor may be surrounded by two bandage forming half shells which can provide an adequate seal. Such a window formation, while guaranteeing long term sealing and stability of the dielectric material, has a disadvantage in that the cross-sectional change between the window and the adjacent hollow conductor sections adds an undesired reflecting conductor load and requires exactly produced precisely fitting parts.

While the use of rectangular windows are known (see U.S. Pat. No. 3,101,460 to Walker et al. issued Aug. 20, 1963 or Chapter II,D. proc. IEEE, Volume 61, No. 3, 1973 pages 299–330), such windows have been used in arrangements which leave the cross-section of the hollow conductor channel unchanged. Although windows are particularly reflection poor however density problems occur. That is, since the circumferential peripheral surfaces of the window meet at a sharp angle, the mating dimensions of the other members of the assembly which are to be connected together, as by soldering, have to be dimensioned to a high degree of exactness and, in particular, have to be provided with mating sharp angle edges. This can result in the creation of inadmissibly wide gaps or interfering heat displacements.

It would therefore be an advance in the art to provide a microwave conductor-window assembly where both the window and the conductor in which it is received are rectangular in cross-section and wherein the window is sealed in place in the conductor by a vacuum tight metal seal which can be simply affixed and which does not provide for disadvantageously large gaps.

SUMMARY

In order to eliminate some of the aforementioned shortcomings, and particularly in order to create a wide banded reflection-poor window which can be produced in a simple manner and which is reliably dense and break resistant, we have provided a window arrangement of the above-discussed rectangular cross-section window, rectangular cross-section conductor type, wherein two opposed side walls of the hollow conductor have openings at the location of the ceramic window. The openings have dimensions which correspond approximately to those of the associated sides of the ceramic window, and the openings are closed by small plates of a material having good heat conductivity. A four-part metal bandage is provided with one part of the bandage on each side of the conductor, each of the bandaged parts covers one side of the conductor. Preferably the portions of the bandages on opposed sides overlie portions of the bandages on the adjacent opposed sides. The bandages are preferably soldered in place.

In the embodiment illustrated, by breaking the window frame into a plurality of individual frame parts, the resultant window arrangement provides a form locking, edge exact connection between the dielectric material, the hollow conductor and the tight seal bandage. Further, in such a construction, the fact that the thickness dimension of the window is of great importance and is prescribed in a set manner in each individual case, does not create production tolerance problems and the expansion differences of the individual connecting parts of the window frame will no longer create or effect the solder gap.

Normally the rectangular window and connector are not square but have a long side and a short side. In order to promote mechanical stability in the arrangement according to this invention, it is preferred that the two short sides of the conductor should form a first side pair which are provided with the openings for the window. Further it is desirable to provide the long sides with a solder groove in the area of the central plane of the window.

In a further modification, the hollow conductor is of two parts providing a separating groove in the area of the central plane of the window upon assembly. This groove is at least partially filled with solder material which will aid in providing a tight seal. In such a two piece conductor assembly, the window can be inserted in a very simple manner.

It is therefore an object of this invention to provide an improved microwave window and frame arrangement.

It is a more important object of this invention to provide a microwave window and conductor frame wherein both the window and the frame are of rectangular cross-section, the window being surrounded with a vacuum tight metal bandage sealing the conductor and window in place vis-a-vis one another.

It is another and more important object of this invention to provide a rectangular window-conductor frame assembly wherein a multi-piece metal bandage is used to sealingly assemble the window and frame together in a vacuum tight manner and where dimensional tolerances of the various parts are not critical.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
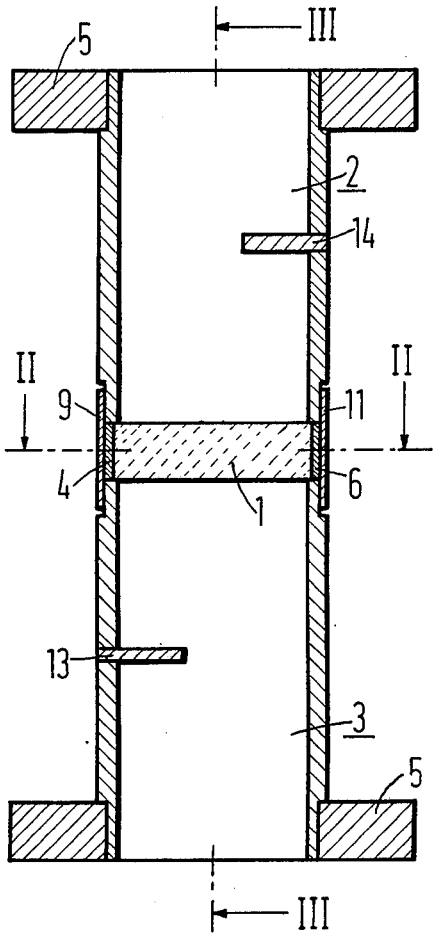
FIG. 1 illustrates a cross-section of the rectangular hollow conductor-rectangular window arrangement of this invention.

The figures illustrate a microwave window such as can be provided for use in high performance travelling wave tubes. The arrangement consists of a rectangular ceramic window 1, two associated rectangular conductor pieces 2 and 3 each of which is provided with connecting flanges 5, two small plates 4, 6 and four seal bandage parts 7, 8, 9 and 11. The conductor pieces 2 and 3 together with the plates 4 and 6 and the four bandage parts 7, 8, 9 and 11 form a frame for the window 1 retaining the window in place in the conductor pieces.

Figure 3:
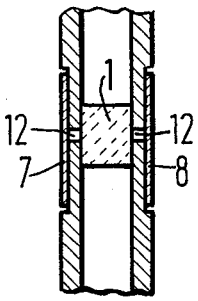
FIG. 3 is a fragmentary cross-sectional view of the window-conductor arrangement of FIG. 1 taken along the lines II–III of FIG. 1.

The individual parts are arranged into a frame assembly as follows. The ceramic window 1, which preferably, has been previously metalized along its circumferential or peripheral outside surfaces is received between the two conductor pieces 2 and 3 which may be spaced from one another along their long or front sides to provide a narrow dividing groove 12 (FIG. 3). The long side fronts project beyond the ends of the short sides so that when the long sides are positioned in opposed condition to one another with the appropriate groove space 12 spacing them, the ends of the short sides will be spaced from one another by a distance which corresponds approximately to the facing side profile of the window 1. This provides openings or recesses through the short sides of approximately the dimension of the window. These recesses are closed by small plates 4, 6. The plates are constructed of a good conducting material, preferably copper sheets. The dimensions of the conductor pieces 2 and 3 are preferably chosen such that the short sides are spaced from one another a distance slightly less than the corresponding distance of the window whereby peripheral portions of the window extend somewhat into the openings in the short sides. In this manner the ends of the short sides provide a stop or a support for the window such that it does not have to be otherwise supported during assembly.

After the window is positioned with respect to the connector pieces, solder is added to the dividing groove 12 and a bandage or sleeve consisting of two long molybdenum strips 7 and 8 and two short molybdenum strips 9 and 11 are applied around the window frame defined by the two long sides and the small plates 4 and 6. The molybdenum strips are dimensioned to extend into contact with, and overlie, portions of the long faces on either side of the solder strip 12 and portions of the short faces on either side of the openings.

Figure 2:
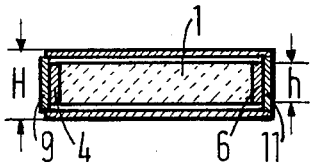
FIG. 2 is a cross-sectional view of the conductor-window arrangement of FIG. 1 taken along the lines II—II of FIG. 1.

This type of a construction provides an assembly in which the individual parts of the window frame and sleeve can be easily dimensioned and connected to one another in such a way that a tight locking connection is provided. By application of pressure to the two shorter molybdenum strips 9 and 11, the frame can be made tight and form locked at the short sides of the window. Further, as long as the width of the plates 4 and 6 is less than the width h of the window 1 and the corresponding width dimension of the strips 9 and 11 is less than a value H (which is equal to the width of the window h plus twice the thickness of the conductor long side walls at the location of the window) the frame can be made tight and form locked at the long sides of the window also. That is to say that with the relationship of the dimensions as given of the plates 4 and 6 and strips 9 and 11 with respect to the dimensions of the mating faces of the window and of that dimension plus twice the thickness of the long side walls, the bandage can be arranged as shown in FIG. 2 with the long strips 7 and 8 overlying ends of the short strips 9 and 11. Further, as illustrated at 9 in FIG. 2, the overlap does not have to be entire but it can be an overlap which extends only for a portion of the thickness of the strips 9 and 11 or, conversely can extend beyond the strips. However in this manner, the bandage can be applied in such a manner as to provide a vacuum tight seal while at the same time, during the application and locking-up of the bandage, it can be assured, through the application of pressure, that the window is tightly held in place within the conductor.

After assembly of the entire window frame and window as described, the resultant assembly is mounted in a solder clamp which is thereafter tightly adjusted to the individual parts, consideration being given to heat expansion of all four sides. Thereafter the resultant assembly is soldered into a final article. In this manner all resultant solder gaps will be maintained extremely small.

The wall strength of the hollow conductor at the location of the window is dependent upon the dimensions of the entire arrangement. It is preferred that the long side ends retain a certain flexibility and ductility without influencing the mechanical stability of the entire arrangement to an undesired extent.

In order to maintain a continuous outer symmetry of the conductor and to provide a desired wall strength, each of the side walls of the conductor can be stepped adjacent the window for receipt of the bandages as illustrated.

In the type of arrangement illustrated, the electrical thickness of the ceramic window 1 would correspond to half the wave length of the transmission. Additionally inductive shutters 13 and 14 may be placed in the wave path both in front and after the window and serve in a known manner for the wide banded adaptation of the dielectrum.

It should be appreciated that our invention is not restricted to the illustrated embodiment but that the window can also be inserted into a one piece hollow conductor section instead of the two-piece embodiment shown. Additionally the openings shown in the short side walls can conversely be placed in the long side walls if desired. Further, in some embodiments, it can be possible to place the openings in adjacent sides of the rectangular conductor.

An important consideration, however, in our invention is the fact that each of the bandage pieces lies on a single plane whereby it is not necessary to form any angles in the individual bandage pieces. Since such angles can not be easily produced with sharp edges, the use of a four part bandage where each part is planar is an advantage.

It can therefore be seen from the above that our invention provides a vacuum tight window arrangement for a rectangular hollow wave guide conductor having a rectangular window received therein, the window being surrounded by a metal bandage enveloping the conductor in the area of the window, the bandage being soldered in place to provide a locked-up conductor-window assembly with a metallic vacuum tight seal having a minimum of solder gaps. In the preferred embodiment the conductor is constructed of two pieces having long sides partially overlapping long sides of the window and having short sides which define openings therethrough having a dimension approximately equal to the thickness of the window, the window extending partially beyond the inner edges of the short sides with the ends of the short sides as defined by the openings in contact with walls of the window, the openings in the short sides being filled with metal spacer plates, the space between the ends of the long sides being filled with solder, and a four piece bandage received around the two connector pieces in the area of the window with the long side portions of the bandage overlying the short side portions of the bandage to provide an effective vacuum tight seal which locks up the entire assembly in final rectangular form.

Although the teachings of our invention have herein been discussed with reference to specific theories and embodiments, it is to be understood that these are by way of illustration only and that others may wish to utilize our invention in different designs or applications.

We claim as our invention:

1. A vacuum tight window arrangement for a rectangular hollow conductor comprising: a wave permeable window having a substantially rectangular shape, the window constructed of dielectric material, a hollow rectangular conductor member receiving the window intermediate ends of the member, a metal bandage tightly surrounding the hollow conductor at the level of the window, the conductor having four side walls, two opposed side walls comprising a first side pair with opposed openings therethrough at the level of the window, the openings having dimensions substantially equal to the dimension of the sides of the window facing the openings, each opening having a plate constructed of a heat conducting material received therein in contact with the side of the window, the metal bandage consisting of four separate parts each of which is positioned at a side of the hollow conductor exterior thereof and covering portions of an associated side, the bandage being fixed in place by soldering and providing a vacuum tight seal around the hollow conductor at the location of the window.

2. A window arrangement according to claim 1 wherein the first side pair comprise the short side walls of a rectangular conductor having long and short side walls, the long walls comprising a second side pair.

3. A window arrangement according to claim 1 wherein the rectangular hollow conductor has four side walls, with two of said side walls comprising the first side pair with openings therethrough and another two of said side walls comprising a second side pair the second side pair of side walls having associated therewith a solder groove in the area of the central plane of the window, said solder groove at least partially filled with solder material.

4. A window arrangement according to claim 3 wherein the hollow conductor comprises two parts separated from one another by the solder groove of the second side pair of sides and by the openings of the first side pair.

5. A window arrangement according to claim 4 wherein peripheral portions of the window extend partially into the openings being defined by end wall portions of the first side pair, the end wall portions contacting opposite sides of the window.

6. A window arrangement according to claim 1 wherein the sides of the hollow conductor have a reduced wall strength at the location of the ceramic window.

7. A window and hollow conductor device for microwave utilizing devices comprising a rectangular shaped hollow conductor member having four sides including two short sides and two long sides, a rectangular shaped wave permeable window constructed of a dielectric material received in said hollow conductor, the short sides of said hollow conductor having openings therethrough intermediate the ends of the hollow conductor, the openings dimensioned approximately equal to the opposed dimensions of the window received therethrough, the window extending within the hollow conductor from the opening in one short wall to the opening in the other short wall, end portions of the window extending partially into said openings and being contacted on opposite sides of the window by end wall portions of the short sides defining the openings, metallic spacer plates received in said openings in contact with walls of the window, a four-piece bandage sleeve received around said hollow conductor in the area of the window, the four-piece bandage sleeve including two shorter pieces engaging the short side walls of the hollow conductor and covering the spacer plates and the openings, two longer pieces of the bandage sleeve contacting the long sides of the hollow conductor, the bandage sleeve pieces being in end overlapping relationship with adjacent bandage sleeve pieces, and the bandage sleeve being fixed in place by soldering and providing a vacuum tight seal around the window.

* * * * *